US006752565B2

(12) United States Patent
Schrage

(10) Patent No.: US 6,752,565 B2
(45) Date of Patent: Jun. 22, 2004

(54) MANHOLE COVER SYSTEM

(76) Inventor: Arthur A. Schrage, 1574 Devonshire, Troy, MI (US) 48098-4375

( * ) Notice: Subject to any disclaimer, the term of this patent is extended or adjusted under 35 U.S.C. 154(b) by 0 days.

(21) Appl. No.: 10/422,195

(22) Filed: Apr. 24, 2003

(65) Prior Publication Data

US 2003/0206770 A1 Nov. 6, 2003

Related U.S. Application Data

(60) Provisional application No. 60/377,091, filed on May 2, 2002.

(51) Int. Cl.[7] ..... E02D 29/14
(52) U.S. Cl. ..... 404/25; 52/20
(58) Field of Search ..... 404/25, 26; 52/19, 52/20

(56) References Cited

U.S. PATENT DOCUMENTS

| | | | | | |
|---|---|---|---|---|---|
| 3,921,494 | A | * | 11/1975 | Coe | 411/344 |
| 4,015,373 | A | | 4/1977 | Boissier | 52/20 |
| 4,203,686 | A | | 5/1980 | Bowman | 404/25 |
| 4,456,397 | A | | 6/1984 | Freis et al. | 404/25 |
| 5,056,955 | A | * | 10/1991 | Spiess et al. | 404/25 |
| 5,195,590 | A | * | 3/1993 | Kenner | 166/379 |
| 5,324,135 | A | * | 6/1994 | Smith | 404/25 |
| 5,340,232 | A | * | 8/1994 | Spiess et al. | 404/25 |
| 5,362,175 | A | * | 11/1994 | Begin | 404/26 |
| 5,462,385 | A | * | 10/1995 | Mohlengraft | 404/25 |
| 5,470,172 | A | | 11/1995 | Wiedrich | 404/25 |
| 5,797,221 | A | * | 8/1998 | Young et al. | 52/20 |
| 5,974,741 | A | * | 11/1999 | Fukuhara | 52/20 |
| 6,007,270 | A | | 12/1999 | Bowman | 404/25 |
| 6,371,687 | B1 | | 4/2002 | Heintz et al. | 404/26 |
| 6,371,688 | B1 | | 4/2002 | Yang et al. | 404/26 |
| 6,422,784 | B1 | * | 7/2002 | Pellegrino et al. | 404/17 |
| 6,520,713 | B2 | | 2/2003 | Sondrup | 404/26 |

OTHER PUBLICATIONS

"News from the Front: The Safety Battle in the Wastewater Industry", Water Environment & Technology, Jun. 1990, pp. 31–32.*

* cited by examiner

*Primary Examiner*—Thomas B. Will
*Assistant Examiner*—Alexandra K. Pechhold
(74) *Attorney, Agent, or Firm*—Gifford, Krass, Groh, Sprinkle, Anderson & Citkowski, P.C.

(57) ABSTRACT

A cover system in use with a pavement slab, a communicating and downwardly extending manhole tube extending from the slab. The system includes a substantially annular shaped and three dimensional frame, encased within the pavement slab and such that a top edge extending surface of the frame lies substantially flush with a corresponding top edge surface of the slab. The frame further includes an inwardly facing, annular extending and recessed ledge in communication with the manhole tube. A cover is seatingly engaged and supported upon the recessed ledge, such that an upper edge surface of the cover is substantially flush with the top edge extending surface of the frame. A plurality of locking fasteners are arrayed at an angle relative to a perpendicular axis extending through the cover and the frame. The fasteners insert within corresponding angular recesses established between the frame and the cover and are displaceable between a locking position, in which the cover is rigidly secured to the frame and an unlocked position, in which the cover is removable from the frame.

20 Claims, 4 Drawing Sheets

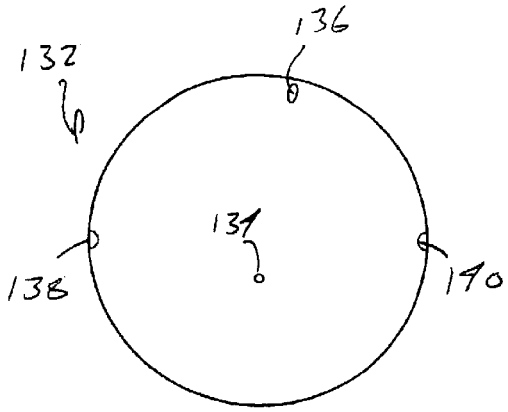
Fig-11
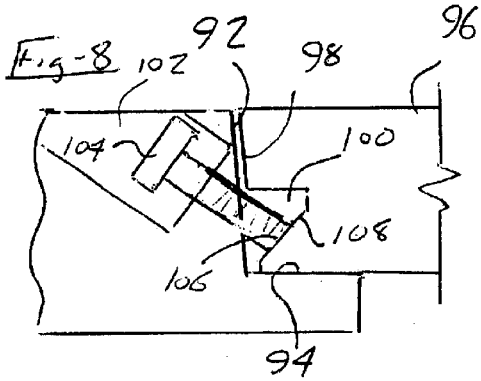
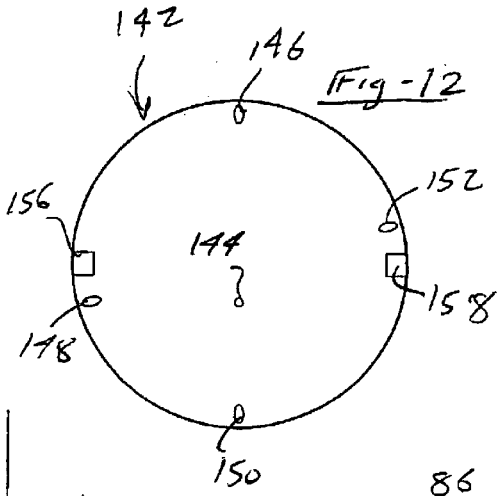
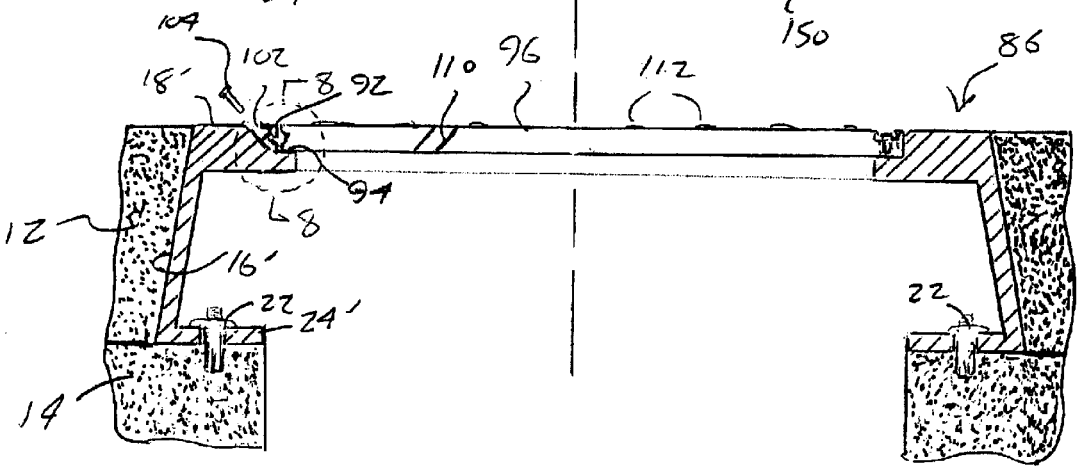
Fig-7

MANHOLE COVER SYSTEM

CROSS REFERENCE TO RELATED APPLICATIONS

The present application claims priority of U.S. Provisional Application Serial No. 60/377,091 filed May 2, 2002, and entitled A-Frame Manhole Frame & Cover.

BACKGROUND OF THE INVENTION

1. Field of the Invention

The present invention relates generally to manhole cover technology and, more specifically, to a manhole system incorporating at least a uniquely configured cover, in addition to a likewise uniquely configured frame associated with the cover and separately secured to an upper extending end of a manhole wall. The system provides the advantages of more secure engagement and removal of the cover, and associated reduction in the occurrence of injury to a worker engaged in removing the cover. Additionally, an outwardly annular facing and tapered configuration of the frame results in a decrease of the likelihood of expansion and contraction forces exerted by the cement causing the cover and/or frame from projecting upwardly from a level surface established with the pavement.

2. Description of the Prior Art

The relevant art is well documented with various examples of manhole cover and construction assemblies. The manhole assembly typically includes such as a substantially level slab of concrete or pavement, exhibiting such as an annular central aperture communicating with a downwardly extending manhole wall, typically also of concrete construction.

Due to variances which may exist in the concrete, one application is prior art is directed to various types of leveling and height adjusting manhole assemblies. Included among these are references such as Heintz et. al., U.S. Pat. No. 6,371,687 which teaches a manhole covering frame leveling clip, attachable by friction fit to an exterior peripheral flange of a manhole cover frame. An adjustable bolt extends through the clip and in order to manipulate the height and angle of the frame so that the frame is in the same plane or elevation with the finished grade of a roadway surface. Other examples of height adjustable manhole assemblies include those disclosed in U.S. Pat. No. 6,520,713, issued to Sondrup and U.S. Pat. No. 5,470,172, issued to Wiedrich.

U.S. Pat. No. 4,203,686, issued to Bowman, teaches a liquid tight manhole closure structure exhibiting a base frame with an upwardly sloping and outwardly oblique surface adjacent an upper located and peripheral inner seat upon which a cover is seated. A retainer ring detachably secures the cover onto the frame and the ring and frame further exhibit peripheral coacting and detachably interlocking cam surfaces for removably securing the ring to the frame. A resilient sealant is disposed between the cover and the frame to prevent liquid seepage through the manhole opening. The sealant may further be vulcanized or otherwise secured directly to the periphery of the cover and/or to the frame.

Additional references, including U.S. Pat. No. 6,007,270, issued to Bowman, U.S. Pat. No. 6,371,688, issued to Yang et al., and U.S. Pat. No. 4,015,373, issued to Boissier, round out the teachings of the prior art. Bowman U.S. Pat. No. 6,007,270 teaches a lockable manhole frame assembly capable of supporting a member for obstructing a utility access opening (manhole cover) and which is in particular suitable for raising the level of the obstructing member to the level of such as a repaved roadway.

Yang U.S. Pat. No. 6,371,688 teaches a manhole cover mounting structure having an outer frame fastened to a manhole box by screw bolts and including an upright guide rod in each of a plurality of hollow peripheral locating blocks. An inner frame is adjustably fastened within the outer frame and in order to hold a cover plate in flush condition with a roadway surface. The inner frame includes a plurality of female screws fastened to peripheral lugs to hold a respective hollow screw rod for the mounting of through bolts, thereby securing the inner frame to the upright guide rod in each locating block of the outer frame.

Finally, Boissier U.S. Pat. No. 4,015,373 teaches a manhole assembly including a flat outer frame provided with an edge-section for receiving a single-piece manhole cover exhibiting three projections located at the apices of a triangle and which are adapted to rest on the edge-section so as to form a horizontal bearing triangle. The cover is further adapted to be locked within the frame and so as to prevent tilting of the cover about any one side of the bearing triangle under the action of a downwardly directed force applied to the cover externally of the triangle.

SUMMARY OF THE PRESENT INVENTION

The present invention teaches a manhole system designed to overcome a number of shortcoming associated with the prior art manhole assemblies, and in particular incorporates a uniquely configured cover, in addition specified embodiments including a likewise uniquely configured frame associated with the cover and which is separately secured to an upper extending end of a manhole wall.

As previously explained, the manhole system provides the advantages of more secure engagement and removal of the cover, along with an associated reduction in the occurrence of injury to a worker engaged in removing the cover. Additionally, an outwardly annular facing and tapered configuration of the frame results in a decrease of the likelihood of expansion and contraction forces exerted by the cement causing the cover and/or frame from projecting upwardly from a level surface established with the pavement.

In a first preferred embodiment, a substantially annular shaped and three dimensional frame is provided and which is encased within the pavement slab such that a top edge extending surface of the frame lies substantially flush with a corresponding top edge surface of the slab. The frame, as previously described, includes in this embodiment the outer annular facing and tapered configuration such that the expansion and contraction forces of the adjoining concrete are directed in a substantially parallel and upwardly directed fashion, relative to the outer annular surface of the frame and to prevent the frame from being projected upwardly as a result of such forces.

An intermediate ring is supported upon an annular and recessed ledge defined in an inwardly and annular extending fashion within the frame. The ring in turn defines a recessed annular rim upon which a cover is seatingly engaged and supported and further such that an upper edge surface of the cover is substantially flush with the top edge extending surface of the ring and the frame.

Any plurality of locking fasteners are provided and are arrayed at an angle relative to a perpendicular axis extending through the cover and the ring. The locking fasteners are typically provided as interiorly threaded recesses, extending in a radially inward and downward fashion, and each of which receiving a threaded bolt displaceable between a locking position, in which the cover is rigidly secured to the ring and frame, and an unlocked position, in which the cover is removable. A further modification of the cover system incorporates the intermediate ring into the frame and such that the combination defines a single integral piece within which the cover is supported.

The cover, in either variant exhibits an upwardly and centrally extending sloping top surface. A pick hole is formed at an angle relative to a perpendicular axis extending through the cover and frame and such that a conventional tool can be engaged to unseat the cover. Additionally, a plurality of raised projections may be defined upon the top surface of the cover to facilitate fluid run-off. Also, one or more vertically extending bolts are threadably and recess seated at locations around a periphery of the cover and actuated downwardly to engage a corresponding top surface of the frame, in order to break a seal existing therebetween and to unseat the cover from the frame.

A yet further embodiment of the present invention contemplates either producing a manhole cover, as described above, for use in an existing and convention frame or, alternatively, of retrofitting or modifying an existing manhole cover for use in such an assembly. The cover, according to either sub-variant, includes the provision of at least the angularly defined pick hole, defined at an intermediate location along the body of the cover and which is best suited for receiving a pick or the like, as well as one or more radially outwardly and downwardly angled threaded recesses for receiving a lock bolt and for securely engaging the cover to an adjoining and inwardly facing wall of the existing frame.

BRIEF DESCRIPTION OF THE DRAWINGS

Reference will now be made to the attached drawings, when read in combination with the following detailed description, wherein like reference numerals refer to like parts throughout the several views, and in which:

FIG. 7 is a side cutaway view, similar to that shown in FIG. 2, and illustrating a modified frame with integrally formed ring according to a second preferred embodiment of the present invention;

FIG. 8 is an enlarged partial illustration as indicated at 8—8 in FIG. 7 and illustrating the manner in which a selected lock bolt association with the frame of FIG. 7 is engaged with an outer annular rim location of the associated cover;

FIG. 11 is a top view of a retrofitted cover according to a yet further embodiment of the present invention and illustrating features such as the pick hole and lock bolts according to the present invention; and FIG. 12 is a top view of a still further embodiment of a retrofitted cover and illustrating a plurality of lock bolts according to the present invention.

DETAILED DESCRIPTION OF THE PREFERRED EMBODIMENTS

Referring collectively to FIGS. 1–6, a manhole cover system is illustrated at 10 according to a first preferred embodiment of the present invention. As previously described, the cover system provides the advantages of more secure engagement and removal of the cover, along with an associated reduction in the occurrence of injury to a worker engaged in removing the cover.

Figure 1:
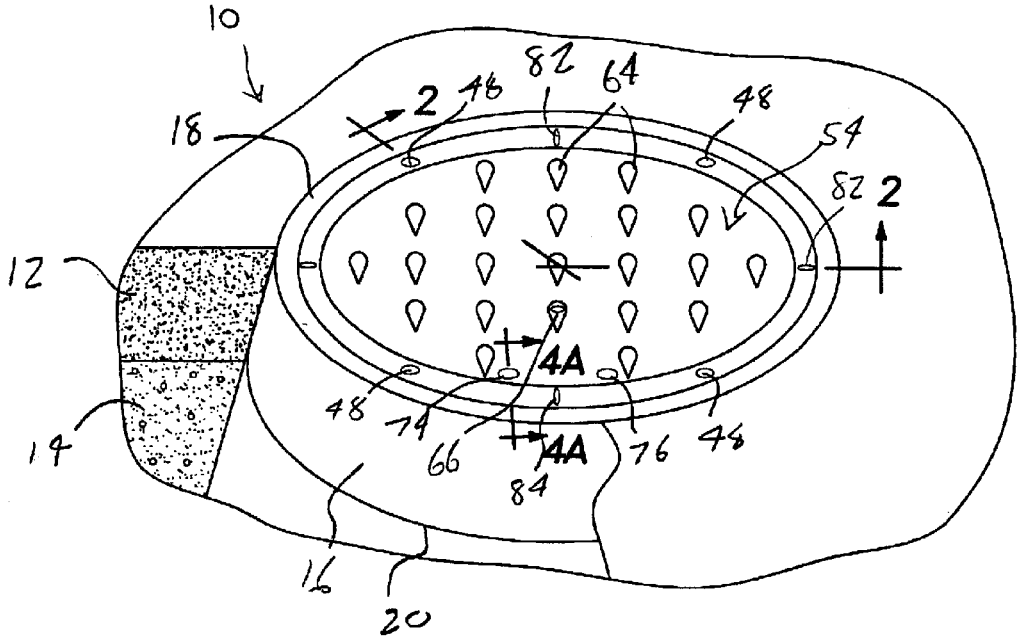
FIG. 1 is a perspective view in partial cutaway and which illustrates the manhole cover system, and exhibiting in particular the outwardly annular tapered configuration of the frame according to a first preferred embodiment of the present invention.
Figure 2:
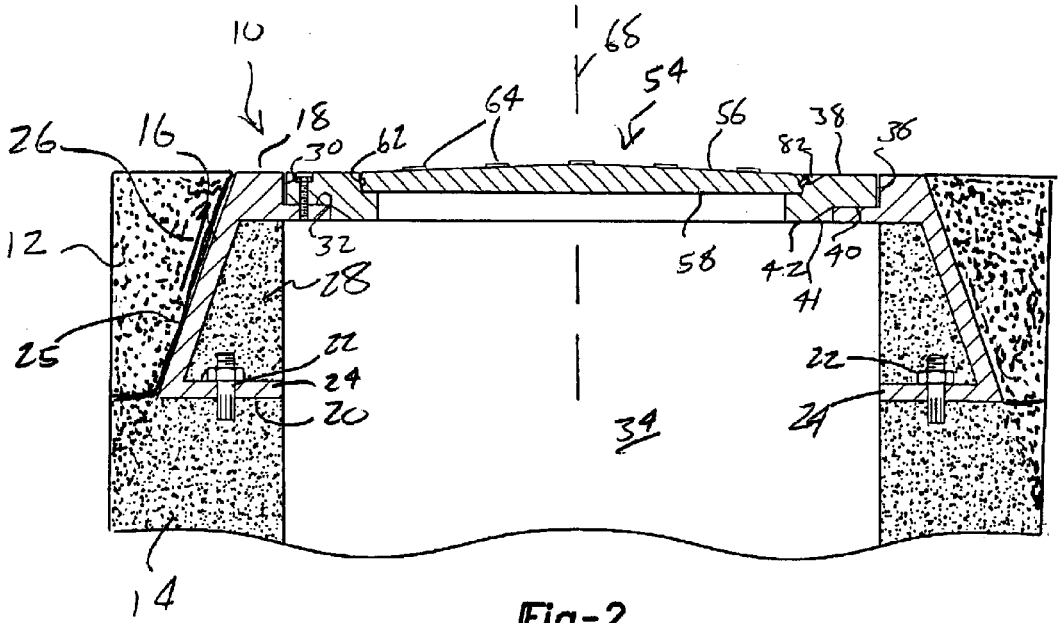
FIG. 2 is a side cutaway view taken along line 2—2 of FIG. 1 and illustrating the frame, ring and cover components of the manhole cover system according to the embodiment of FIG. 1.

As best illustrated in FIGS. 1 and 2, the cover system 10 is in use with a conventional pavement slab 12 and a communicating and downwardly extending manhole tube 14, such as which in combination define a manhole assembly as is known in the art. It is also understood that the system 10 can be used with a level ground surface, such as dirt, grass and gravel in given applications within the scope of the invention. The cover system 10 according to the first embodiment includes a substantially annular shaped and three dimensional frame defined in relevant part by an outwardly tapered and exterior facing surface 16 extending between a top end 18 and a bottom end 20 of the frame.

The frame is constructed of a suitable material, such as a iron or the like, and is secured atop the manhole tube 14 by such as bolts 22 which seat through an apertures associated with selected locations of a circumferential bottom flange 24 of the frame and into a poured or pre-casted concrete associated with the manhole tube 14. It is further contemplated and understood that the depth of the frame at least equal to that of the poured concrete 12. As is also shown in FIG. 2, an expansion material 25, such as in a roll form, is applied around the exterior annular surface of the frame and in order to provide for relative movement between the frame and adjoining pavement.

An advantage which has been determined from the outwardly tapered frame construction is the ability of the frame to avoid being dislodged from level placement within the poured pavement slab 12, and such as which can result from the cycles of expansion and contraction associated with the slab. As best shown in the side cutaway of FIG. 2, the forces of expansion (illustrated by arrow 26) have been found to dissipate in a direction generally parallel to the tapered outer surface of the frame, as opposed to the frame itself in instances where it displays a flat, perpendicular side wall.

A shortcoming of frame constructions in the prior art is the tendency of the frame, or more particularly the cover associated therewith, to be projected out of level position with the slab 12 in response to the expansion and contraction cycles of the concrete. In an attempt to provide additional stabilizing support to the frame, and as is again illustrated in FIG. 2, an additional volume of concrete 28 is poured within a three dimensional band established by the frame and such that it establishes a weighted and stable relationship with the manhole tube 14.

Figure 3:
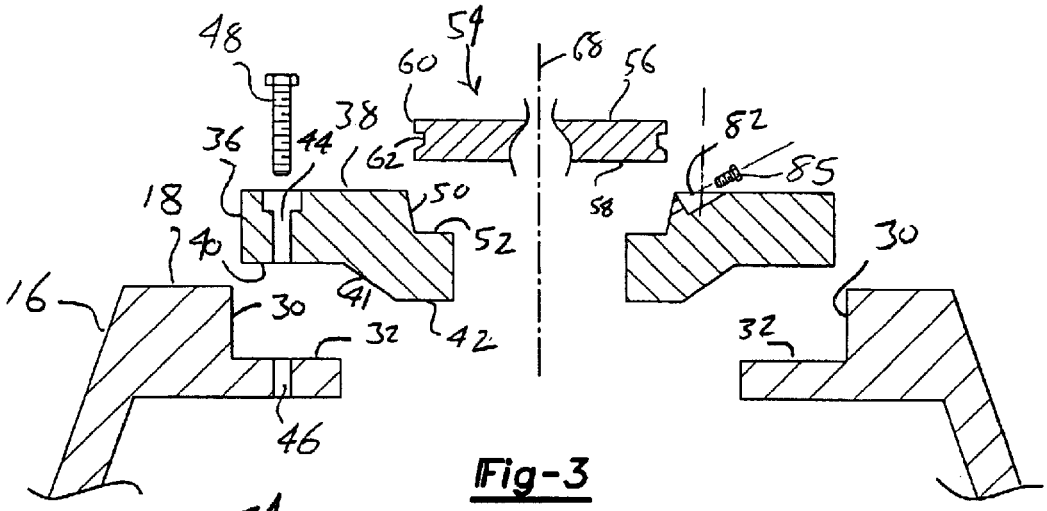
FIG. 3 is an exploded side view, in reduced diameter illustration, of the manhole cover system according to the first preferred embodiment and illustrating in particular the manner in which the ring and cover are interconnected with the frame.

As illustrated again in reference to FIGS. 1 and 2, as well as subsequent reference to FIG. 3, the frame further includes an inwardly facing and annular extending recessed ledge, defined by annular extending inner side wall 30 and base wall 32. The recessed ledge communicates the manhole assembly with the open interior 34 (again FIG. 2) established within the manhole tube 14.

An intermediate ring, typically constructed of iron or other like material, is provided and includes an outer annular side wall 36, top wall 38 and an inwardly/downwardly stepped bottom walls 40 and 42, further separated by angular intermediate wall 41. As best shown in FIG. 3, one or more vertical recesses are formed in aligning fashion through the thickness of the ring, see countersunk recess at 44 in FIG. 3, as well as such as at 46 in likewise vertical fashion through the base wall 32 of the frame. At least the apertures 46 are internally threaded and such that one or more bolts 48 are inserted to secure the ring onto the recessed ledge defined by the frame.

The ring in turn defines a recessed annular rim, illustrated by angled side surface 50 and interconnected base surface 52 (see FIG. 3). The rim annular recess is configured such that an iron cover, see generally at 54, is seated in a substantially flush supported fashion (FIGS. 1 and 2) relative the intermediate ring and outer frame components. Also, the surfaces 50 and 52, associated with the frame in any variant, are beveled in order to reduce sliding friction between the cover and the frame during removal of the cover. Although, illustrated in two dimensional fashion in FIG. 3, it is well understood that the surfaces 50 and 52 establish a three dimensional bevel shape and such as are further shown at 51 and 53.

The cover 54 exhibits a substantially annular shape and includes an upwardly/centrally sloping top surface 56, a bottom surface 58, and a side surface 60 within which is defined a perimeter extending and outwardly facing recess 62. In a preferred variant, the sloping top surface 56 of the cover 54 extends to a central apex of about 3/16" above a level established by top surface 38 of the ring. Also, a plurality of individual raised projections 64 are defined at spaced apart locations across the top sloping face of the cover 54 and serve the function of further preventing excessive volumes of water from accumulating and seeping through the cover.

Figure 5:
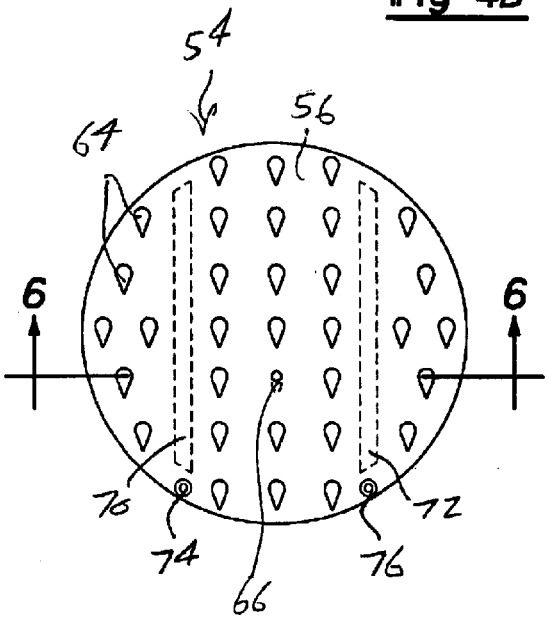
FIG. 5 is a top sectional view of the cover associated with the system according to the first preferred embodiment.
Figure 6:
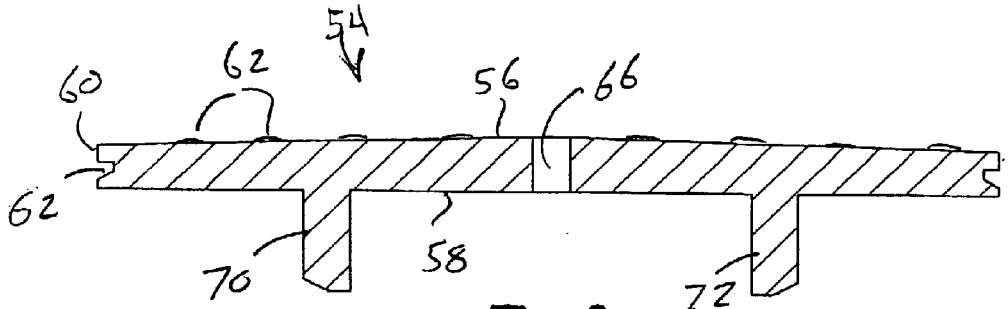
FIG. 6 is a side cutaway view, taken along line 6—6 of FIG. 5, and again illustrating the features of the cover, namely including the upwardly sloping configuration of the top surface, individual raised projections, angled pick hole and downwardly projecting skids according to the present invention.

Additional features associated with the cover 54 include a pick hole 66, extending through the cove at an angle relative a perpendicular axis 68 (see as best referenced in FIG. 5) and at an intermediate location across the body of the cover. The advantage of the angled pick hole 66 is to facilitate the engagement of the cover by a suitable and conventional tool, which is not shown but understood to include such as a pick axe or the like, and to facilitate the engagement and retrieval of the cover 54 from atop the manhole frame. To further assist in removal of the cover 54, a pair of parallel spaced apart and downwardly projecting skids 70 and 72 (see as best shown in FIGS. 5 and 6) are provided and, upon extracting the cover 54 from the recessed ledge (ring surfaces 50 and 52) by use of the conventional pick axe, enable the cover 54 to be more easily slided upon the surface of the pavement slab 12.

Figure 4A:
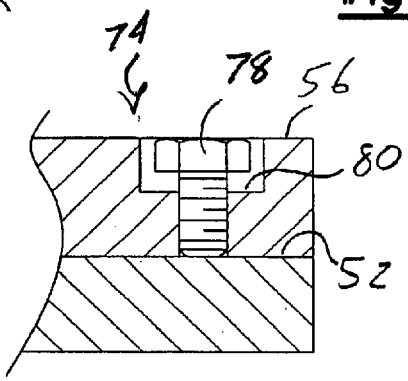
FIG. 4A is a side cutaway view taken along line 4*a*—4*a* of FIG. 1 and illustrating a threadably engaged and vertically displaceable bolt, associated with the cover, in a first position.
Figure 4B:
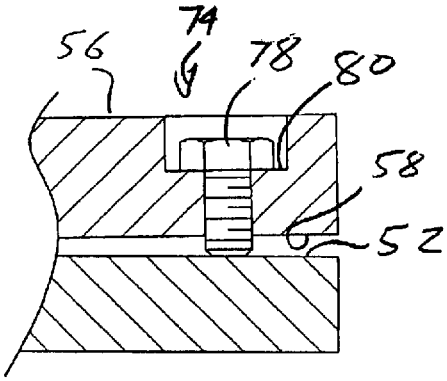
FIG. 4B is a view similar to that shown in FIG. 4A, and further showing the bolt in a second displaced position in which the cover is upwardly actuated, relative to a corresponding upper surface of the ring, and in order to rupture a seal established between the cover and ring.

With further reference to the side cutaway views of FIGS. 4A and 4B, a vertically extending, typically counter sunk, recess is formed through at least one, and typically a pair, of perimeter extending locations 74 and 76 (see also FIGS. 1 and 5) of the cover 54. The countersunk recess location 74 is illustrated in FIGS. 4A and 4*b* and seated within each of the recesses is a threadably engaged and vertically displaceable bolt 78.

In a first position, as illustrated in FIG. 4A, the head of the bolt 78 is illustrated substantially flush with the top surface 56 of the cover and so that the head is spaced upwardly from an intermediate surface 80 of the countersunk recess. Referring further to FIG. 4B, further shown is the bolt 78 in a second displaced position, in which it is threadably and rotatably engaged in a downwardly translating fashion within the countersunk aperture and such that an end of the bolt engages the ring base surface 52 in order to upwardly actuate the cover 54. In this fashion, a seal established between the cover and ring, such as further resulting from the accumulation of dirt, corrosion of the surfaces and the like, is ruptured and to facilitate easier removal of the cover 54 from the supporting rim or ledge established by the ring.

Referring again to FIGS. 1, 2 and 3, an explanation of the primary locking feature of the cover 54 to the overall manhole assembly 10 is illustrated by the provision of at least one, and preferably a pair of angular recesses 82 and 84 (see FIG. 1) at circumferentially spaced apart locations around the intermediate ring. As best shown in FIG. 3, the recesses see again (82) are established at an angle relative to the perpendicular 68 extending through the cover 54.

In particular, the apertures 82 and 84 are defined in inwardly and downwardly extending fashion, see as best referenced by countersunk angled aperture 82 in FIG. 3, within the upper surface 38 of the ring and in a direction towards the communicating outer side wall of the cover 54. Upon insertion of a locking fastener 85, such as a bolt shown in FIG. 3, the shaft end of each bolt engages with a corresponding location of the perimeter extending recess 62 of the cover 54 and to lock the cover atop the manhole assembly. When it is desired to remove the cover 54, the bolts 85 are loosened, to withdraw the shaft ends from abutting engagement with the perimeter recess 62, and the cover is permitted to be removed in the manner previously described. Additionally, it is under that the bolts 85 are threadably disengaged in such a manner that, in the loosened position, they do not project above the top level surface of the cover and do not require removal from the cover.

In this manner, the cover 54 is rendered safer and easier to remove, as well as being more secure from theft or accidental dislodgement. As an additional note, the configuration of the angled pick hole, as well as the provision of the downwardly translatable bolts for unsealing the cover from the ring, provide the additional features of reducing injury to the users hands and feet.

Referring further to FIG. 7 a side cutaway view is illustrated generally at 86, similar to that shown in FIG. 2, and illustrating a modified frame with integrally formed ring according to a second preferred embodiment of the present invention. The remaining components of the integral and modified frame 86 are as substantially previously described and include tapered side wall 16', bottom flange 24', and top end 18'.

As also illustrated in the enlarged partial illustration of FIG. 8, is the manner in which a selected lock bolt is engaged with an outer annular rim location of an associated cover. In particular, the configuration of the recessed annular rim (defined by surfaces 50 and 52 of the intermediate ring in the embodiment of FIGS. 1–3) is substituted by incorporating like surfaces 92 and 94 defined within an inwardly facing and recessed rim of the frame 86.

A cover 96 is generally provided as previously disclosed and in relevant part includes an annular side wall 98 defining a perimeter extending recess 100 (see again FIG. 8). An angled and threaded recess 102 is illustrated, defined in like fashion in the modified flange arrangement 86 as compared to the description of the intermediate ring 38, and further such that, upon insertion and threadable engagement of a bolt fastener 104, extending end 106 of the bolt 104 abuttingly engages against a recessed and angled surface 108 associated with the perimeter recess 100 and in order to secure the cover 96 in place. The cover 96 is otherwise constructed in a manner consistent with that previously described and may also include such features as an angled pick hole 110, spaced apart projections 112 and the like.

Figure 9:
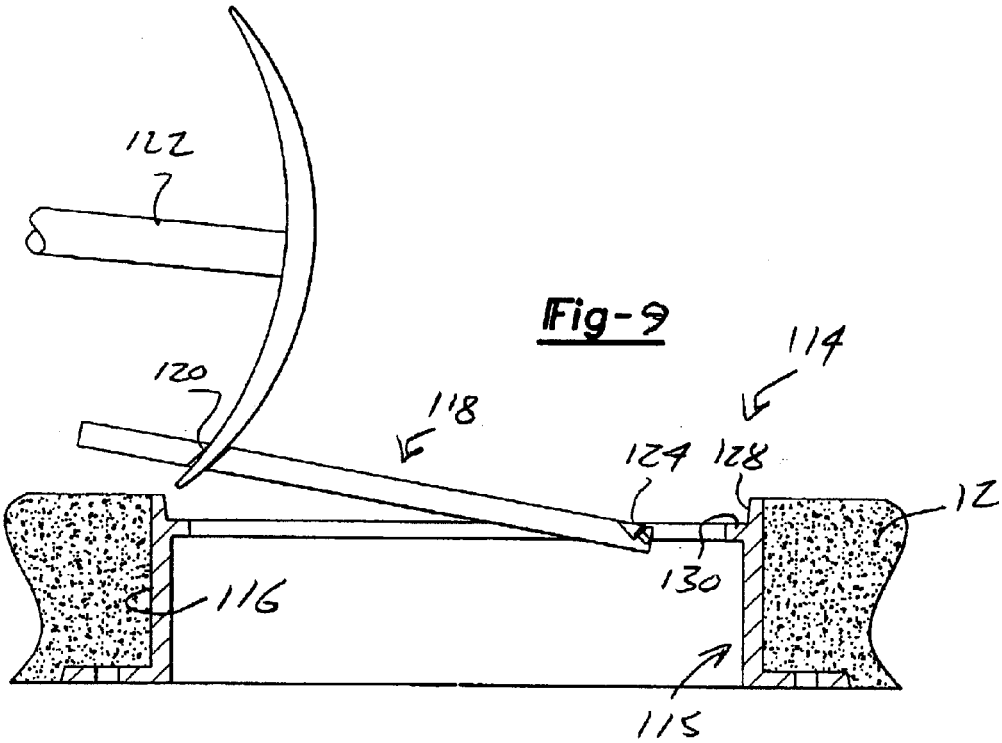
FIG. 9 is an illustration of a modified cover in use with a conventional manhole frame according to a further preferred embodiment of the present invention, and illustrating the feature of the angled pick hole, as well as showing a reverse positioned and outwardly/annularly configured lock bolt for engagement against an inner side wall of the conventional frame.

FIG. 9 illustrates, at 114, a modified cover in use with a conventional manhole frame 115 according to a further preferred embodiment of the present invention. Unlike the overall trapezoidal shape imparted to the frame illustrated in the preferred embodiment of FIG. 1, the frame illustrated in FIG. 9 exhibits a substantially planar outer annular surface, see at 116, as is known in the conventional art.

The present invention contemplates either producing a manhole cover for use in an existing and convention frame or, alternatively, of retrofitting or modifying an existing manhole cover for use in such an assembly. Referring again to FIG. 9, cover 118 according to either sub-variant, includes the provision of at least the angularly defined pick hole 120, defined at an intermediate location along the body of the cover and which is best suited for receiving an inserting end of a pick 122.

Figure 10:
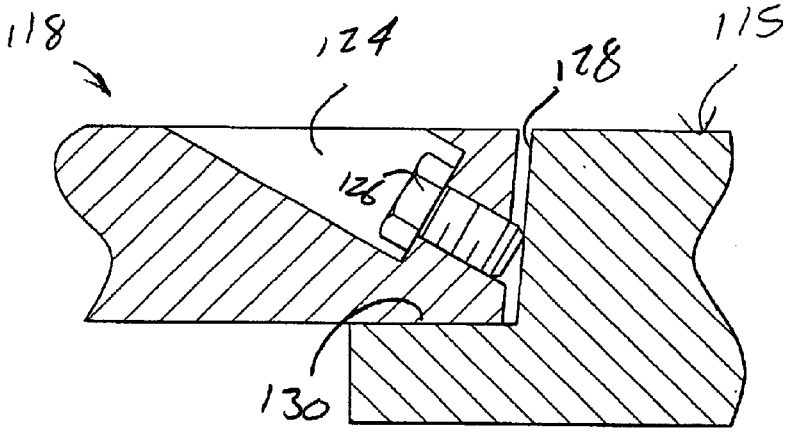
FIG. 10 is an enlarged partial illustration, in side view, and showing engagement configuration of the lock bolt with the frame according to the embodiment of FIG. 9.

One or more radially outwardly and downwardly angled threaded recesses, such as countersunk recesses illustrated in each of FIGS. 9 and 10 at 124, are formed in communication with perimeter extending edge locations of the modified cover 118. As further illustrated, each countersunk recess is again configured receive a lock bolt 126 for securely engaging the cover to an adjoining and inwardly facing annular side wall 128 of the existing frame while the cover 118 is supported upon an interconnecting and associated base wall 130. In this position, the angularly disposed lock bolt 126 is rotated to engage with associated threads placed within recessed side walls associated with the aperture 124, and to thereby force into contact with the side wall 128 the extending end of the bolt 126.

FIG. 11 illustrates a top view of a further retrofitted cover at 132 according to a yet further embodiment of the present invention. The cover 132 illustrates features such as an angled pick hole 134 and a single peripherally configured lock bolt recess 136. Additional features of the cover 132 may include a pair 138 and 140 of pick notches, these also being typically found in existing and retrofitted cover variants. It is also understood that the cover can incorporate any collection of pre-existing features, such as including pick notches and the like, and which the features according to the invention are retrofit applied thereto.

FIG. 12 is a top view of a still further embodiment of a retrofitted cover, see at 142, and again illustrating an angled pick hole 144, as well as a plurality of four perimeter extending lock bolts (locking fasteners) 146, 148, 150 and 152. As with the embodiment of FIG. 11, the angle and position of the locking fastener recesses can be modified and it is also understood that, with reference to existing manhole covers, the selection of a given perimeter extending location for drilling of a locking fastener recess may be according to considerations such as the placement of structural ribs within the manhole cover design. The embodiment 142 of FIG. 12 also illustrates another configuration 156 and 158 of an existing pick notch design at selected peripheral edge locations, this again being in addition to the provision of the angled pick hole 144 as provided in the present invention.

It is evident therefore that the present invention discloses both a manhole cover system, as well as retrofit manhole cover which provides improved features of safety and efficiency in both installation and removal. Having described my invention, additional preferred embodiments, will become apparent to those skilled in the art to which it pertains, and without deviating from the scope of the appended claims:

I claim:

1. A cover system for use with a ground surface and a communicating and downwardly extending manhole tube, said cover system comprising:

a substantially annular shaped and three dimensional frame, encased within the pavement slab and such that a top edge extending surface of said frame lies substantially flush with a corresponding top edge surface of the slab, said frame further including an inwardly facing, annular extending and recessed ledge in communication with the manhole tube;

a cover seatingly engaged and supported upon said recessed ledge, such that an upper edge surface of said cover is substantially flush with said top edge extending surface of said frame; and at least one externally threaded locking fastener arrayed at an angle relative to a perpendicular axis extending through said cover and said frame, said fastener exhibiting a flattened and extending shaft end inserting within at least one corresponding angular recess established between said frame and said cover and displaceable between an extended and locking position, whereby said shaft end is in abutting contact with an opposing side wall location of said frame and so that said cover is rigidly secured to said frame and an unlocked position, in which said abutting shaft end of said fastener is axially retracted and said cover is removable from said frame.

2. The cover system as described in claim 1, said angular recess further comprising an interiorly threaded recess defined, in a radially inwardly directed fashion, within said frame and receiving a threaded bolt.

3. The cover system as described in claim 2, said cover further comprising a perimeter extending and outwardly facing recess configuration for receiving said threaded bolt in said locking position.

4. The cover system as described in claim 1, said angular recess further comprising an interiorly threaded recess defined, in a radially outwardly directed fashion, within said cover and receiving a threaded bolt.

5. The cover system as described in claim 1, said cover further comprising at least one vertically extending recess proximate a perimeter extending location of said cover and in communication with a horizontal surface associated with said recessed ledge, a fastener seating within said vertical recess and which is downwardly actuated to break a seal established between said cover and said recessed ledge.

6. The cover system as described in claim 5, said vertical recess further comprising a counter sunk and interiorly threaded aperture for receiving a threaded bolt.

7. The cover system as described in claim 1, further comprising a pick hole extending through said cover at an angle relative to said perpendicular axis.

8. The cover system as described in claim 1, said cover exhibiting an upwardly/centrally extending slope along an upper surface thereof.

9. The cover system as described in claim 1, further comprising a plurality of raised projections defined at spaced apart locations along an upper surface of said cover.

10. The cover system as described in claim 1, further comprising a pair of elongated, downwardly projecting and parallel spaced skids associated with a lower edge surface of said cover.

11. The cover system as described in claim 1, said frame exhibiting an outwardly tapered configuration.

12. The cover system as described in claim 11, further comprising a volume of concrete poured within an inner annular band established by said frame and coplanar with the manhole tube.

13. The cover system as described in claim 1, said frame further comprising an intermediate ring, within which said recessed ledge is configured and upon which said cover is seatably engaged.

14. A cover system for use with a pavement slab and a communicating and downwardly extending manhole tube, said cover system comprising:

a substantially annular shaped and three dimensional frame, encased within the pavement slab and in communication with the manhole tube such that a top edge extending surface of said frame lies substantially flush with a corresponding top edge surface of the slab, said frame further including an inwardly facing, annular extending and recessed ledge;

an intermediate ring supported upon said annular and recessed ledge, said ring in turn defining a recessed annular rim;

a cover seatingly engaged and supported upon said recessed annular rim, such that an upper edge surface of said cover is substantially flush with said top edge extending surface of said ring and said frame; and at least one externally threaded locking fastener arrayed at an angle relative to a perpendicular axis extending through said cover and said ring, said fastener exhibiting a flattened and extending shaft end inserting within at least one corresponding angular recess established between said ring and said cover and displaceable between an extended and locking position, whereby said shaft end is in abutting contact with an opposing side wall location of said frame and so that said cover is rigidly secured to said ring and an unlocked position, in which said abutting shaft end of said fastener is axially retracted and said cover is removable from said ring.

15. The cover system as described in claim 14, said angular recess further comprising an interiorly threaded recess defined in an inwardly and downwardly directed fashion within said ring, a threaded bolt being received within said threaded recess and in contact with a selected peripheral location of said cover.

16. A manhole cover for use with a substantially annular shaped and three dimensional frame encased within a pavement slab and a communicating and downwardly extending manhole tube, said cover comprising:

a substantially disk shaped body, defining an outer peripheral rim, and which is seatably received upon a corresponding inner annular rim defined by the frame;

a pick hole formed through said manhole cover at a selected and intermediate location of said body, said pick hole being formed at an angle relative to a perpendicular axis extending through said cover and the frame; and at least one radially outwardly and downwardly angled recess formed in said cover, in communication with said outer peripheral rim and the inner annular rim of the frame, an externally threaded locking fastener exhibiting a flattened and extending shaft end inserting within said angled recess and being axially displaceable between an extended and locking position, whereby said shaft end is in abutting contact with an opposing side wall location of the frame and so that said cover is rigidly secured to said frame, and an unlocked position in which said abutting shaft end of said fastener is axially retracted and said cover is removable from said frame.

17. The manhole cover as described in claim 16, said angular recess further comprising an interiorly threaded recess defined in said cover and for receiving a threaded bolt.

18. The manhole cover as described in claim 17, further comprising a plurality of interiorly threaded recesses defined in circumferentially spaced apart locations around said peripheral rim of said cover.

19. A cover system for use with a ground surface and a communicating and downwardly extending manhole tube, said cover system comprising:

a substantially annular shaped and three dimensional frame, encased within the pavement slab and such that a top edge extending surface of said frame lies substantially flush with a corresponding top edge surface of the slab, said frame further including an inwardly facing, annular extending and recessed ledge in communication with the manhole tube;

a cover seatingly engaged and supported upon said recessed ledge, such that an upper edge surface of said cover is substantially flush with said top edge extending surface of said frame, said cover further comprising at least one vertically extending recess proximate a perimeter extending location of said cover and in communication with a horizontal surface associated with said recessed ledge, a fastener seating within said vertical recess and which is downwardly actuated to break a seal established between said cover and said recessed ledge; and at least one locking fastener arrayed at an angle relative to a perpendicular axis extending through said cover and said frame, said fastener inserting within at least one corresponding angular recess established between said frame and said cover and displaceable between a locking position, in which said cover is rigidly secured to said frame and an unlocked position, in which said cover is removable from said frame.

20. A cover system for use with a ground surface and a communicating and downwardly extending manhole tube, said cover system comprising:

a substantially annular shaped and three dimensional frame, encased within the pavement slab and such that a top edge extending surface of said frame lies substantially flush with a corresponding top edge surface of the slab, an exterior facing surface of said frame defining an outward taper between said top edge and a bottom edge and in order to dissipate externally applied forces of expansion in a direction generally parallel to said tapered outer surface, said frame further including an inwardly facing, annular extending and recessed ledge in communication with the manhole tube;

a cover seatingly engaged and supported upon said recessed ledge, such that an upper edge surface of said cover is substantially flush with said top edge extending surface of said frame; and at least one locking fastener arrayed at an angle relative to a perpendicular axis extending through said cover and said frame, said fastener inserting within at least one corresponding angular recess established between said frame and said cover and displaceable between a locking position, in which said cover is rigidly secured to said frame and an unlocked position, in which said cover, is removable from said frame.

* * * * *